United States Patent [19]

Newberry et al.

[11] Patent Number: 4,776,046

[45] Date of Patent: Oct. 11, 1988

[54] PORTABLE, PEDESTAL TABLE FOR HOT TUBS, SPAS AND WHIRLPOOLS

[76] Inventors: Tim R. Newberry, 667 Ogden Canyon, Ogden, Utah 84401; Robin C. Newberry; Dennis Anderson, both of 5171 S. 1200 West, Ogden, Utah 84405

[21] Appl. No.: 21,806

[22] Filed: Mar. 4, 1987

Related U.S. Application Data

[63] Continuation-in-part of Ser. No. 940,343, Dec. 11, 1986, which is a continuation-in-part of Ser. No. 825,477, Feb. 3, 1986, abandoned.

[51] Int. Cl.[4] ..... E03C 1/02; A61H 33/02

[52] U.S. Cl. ..... 4/541; 4/542; 4/574; 4/546; 4/622; 128/65; 128/66

[58] Field of Search ..... 4/541, 542–544, 4/546, 574, 573, 622, 487; D24/38; 5/453, 451; 128/66, 65, 24.1, 400, 25 B; 137/202

[56] References Cited

U.S. PATENT DOCUMENTS

| | | | |
|---|---|---|---|
| 3,964,472 | 6/1976 | Nicollet | 128/66 |
| 4,019,502 | 4/1977 | Elkins | 128/65 |
| 4,099,522 | 7/1978 | Alenares | 128/66 |
| 4,149,281 | 4/1979 | Bob et al. | 4/487 |
| 4,269,797 | 5/1981 | Mikiya et al. | 4/543 X |

*Primary Examiner*—Henry K. Artis

*Attorney, Agent, or Firm*—Thorpe, North & Western

[57] ABSTRACT

A pedestal table which is to be releasably secured to the floor area of a smooth surfaced hot tub, spa or whirlpool and includes a foot massage device powered by pressurized water from the whirlpool. The table includes a base member or pedestal having at least three elastomeric suction cups facing downwardly to come into contact with the floor area. An elongate, cylindrical column extends upwardly from the base member or pedestal through the water in the hot tub, spa or whirlpool to support a table top above the surface of the water. A supplemental column can be provided which supports the table top substantially in the plan of the top of the spa, and in such position, the table top serves as a center support for a rigid cover placed over the spa when the spa is not in use.

12 Claims, 2 Drawing Sheets

PORTABLE, PEDESTAL TABLE FOR HOT TUBS, SPAS AND WHIRLPOOLS

This is a continuation-in-part application of Ser. No. 06/940,343 filed Dec. 11, 1986, which was a CIP of application Ser. No. 06/825,477 filed on Feb. 3, 1986 abandoned.

BACKGROUND OF THE INVENTION

1. Field

The present invention relates to a pedestal table to be used with and in a hot tub, spa or whirlpool such that the top of the table is positioned above the surface of the water. More particularly, the present invention relates to a pedestal table in which the pedestal of the table is adapted to be firmly but releasably secured to the floor area of a hot tub, spa or whirlpool, whereby the shaft of the table extends vertically through the water to support a table top above the surface of the water and includes a submersible water-powered foot massage device supported around the pedestal.

2. State of the Art

The use of private hot tubs, spas or whirlpools has become very popular. It is estimated that there are over 4,500,000 spas in private use as of February, 1986. Private spas are currently selling at a rate of over 400,000 per year and industry projections indicate that there will be about 8,000,000 privately owned spas by 1992. Sitting in a spa or hot tub is an exhilarating experience and has clearly become a very popular means of recreational relaxation. Generally, however, after having spent several minutes in a spa or hot tub, the lure of the spa subsides and the user's attention wanes.

To increase the usefulness of the spa or hot tub and to lengthen the span of interest and enjoyment, it has been suggested to provide a table or floating support of some type for drinks and for use with other activities. One large manufacturer of bathroom fixtures makes a relatively expensive spa which is available with an optional built-in table permanently mounted within the spa. However, there has been no portable, inexpensive table which can be quickly and easily installed and removed from a spa and which does not require permanent mountings built into the spa itself.

Floating tables and similar devices have been proposed for holding food or drinks; however, the irregular movement of the surface of the water is highly unstable. Furthermore, floating devices tend to drift from the user.

OBJECTIVES

A principal objective of the present invention is to provide a portable, pedestal table for use in hot tubs, spas, whirlpools, etc., wherein the pedestal of the table is releasably secured to an unmodified floor area of the hot tub, spa or whirlpool without harming or otherwise affecting the floor surface in any way and provides a location to support the feet of a user over an array of water jets for foot massaging action.

A further objective of the present invention is to provide such a portable, pedestal table for use in hot tubs, spas, whirlpools, etc., wherein the table can be quickly and easily installed in or removed from the hot tub, spa or whirlpool, and further can be quickly disassembled when removed from the hot tub, spa or whirlpool into component pieces which are easily stored for future use.

An additional objective of the present invention is to provide such a portable pedestal table wherein elastomeric suction cups are provided with means whereby the suction cups are easily deformed temporarily to allow the suction cups and the pedestal base to be removed from the floor area of the hot tub, spa or whirlpool.

A still further objective of the present invention is to provide such a portable, pedestal table wherein a central opening is provided in the table top coaxial with the column of the pedestal support, and the column of the pedestal support has a hollow core which is adapted to receive the staff of a patio-type umbrella inside the core of the column, whereby the umbrella can be used with the table top in place on the pedestal column or the table top can be removed with the pedestal column then supporting only the umbrella.

Another objective of the present invention is to provide such a portable, pedestal table which is generally inexpensive but yet is attractive and durable, being manufactured of materials which are impervious to water and will not deteriorate.

SUMMARY OF THE INVENTION

In accordane with the present invention a portable, pedestal table is provided for use in hot tubs, spas, whirlpools, etc., in which the novel table makes possible multiple activities which heretofore were not readily available in a spa environment. Such activities include eating, entertaining, serving refreshments, reading, playing board games, doing paperwork, playing cards, doing handiwork and crafts as well as numerous other activities one chooses in which a table is used. The pedestal table is easily and quickly secured in a releasable manner to the floor area of a smooth-surfaced hot tub, spa or whirlpool. The central support shaft of the table extends vertically through the water in the hot tub, spa or whirlpool to support a table top and/or an umbrella above the surface of the water.

The pedestal table comprises a base member or pedestal which is releasably secured to the floor area of the hot tub, spa or whirlpool. The base member includes a generally cylindrical collar having open first and second ends. A peripheral flange is provided at the first end of the collar. At least three elastomeric suction cups are attached to the peripheral flange such that the suction cups are equally spaced about the peripheral flange and collar. The suction cups extend downwardly from the side of the flange which faces in a direction away from the first end of the cylindrical collar. The suction cups can be engaged with the floor area of the hot tub, spa or whirlpool to releasably secure the collar to the floor area in an upright position in which the second end of the collar faces a direction vertically upward from the floor area of the hot tub, spa or whirlpool.

An elongate, cylindrical column is provided, with the first end of the column being receivable within the second open end of the collar such that the column extends vertically upward through the water in the hot tub, spa or whirlpool when the base member or pedestal is secured to the floor area of the hot tub, spa or whirlpool. A planar top member is provided with means for attaching the top member to the second end of the column, such that the top member is supported in a generally horizontal position above the surface of the water in the hot tub, spa or whirlpool.

The column supports a submersible platform having an upper surface adapted for supporting contact of bare feet. A plurality of water jets communicate from below the upper surface to open space immediately thereabove and have openings sufficiently narrow to maintain a pressure head of water flowing therethrough. Connecting conduit is provided for carrying water under pressure from the outlet port of the whirlpool system to the jets.

Additional objects and features of the novel pedestal table of the present invention will become apparent from the following detailed description, taken together with the accompanying drawing.

THE DRAWING

A preferred embodiment of the novel pedestal table of the present invention representing the best mode presently contemplated of carrying out the invention is illustrated in the accompanying drawings in which.

DETAILED DESCRIPTION OF THE ILLUSTRATED EMBODIMENT

Figure 1:
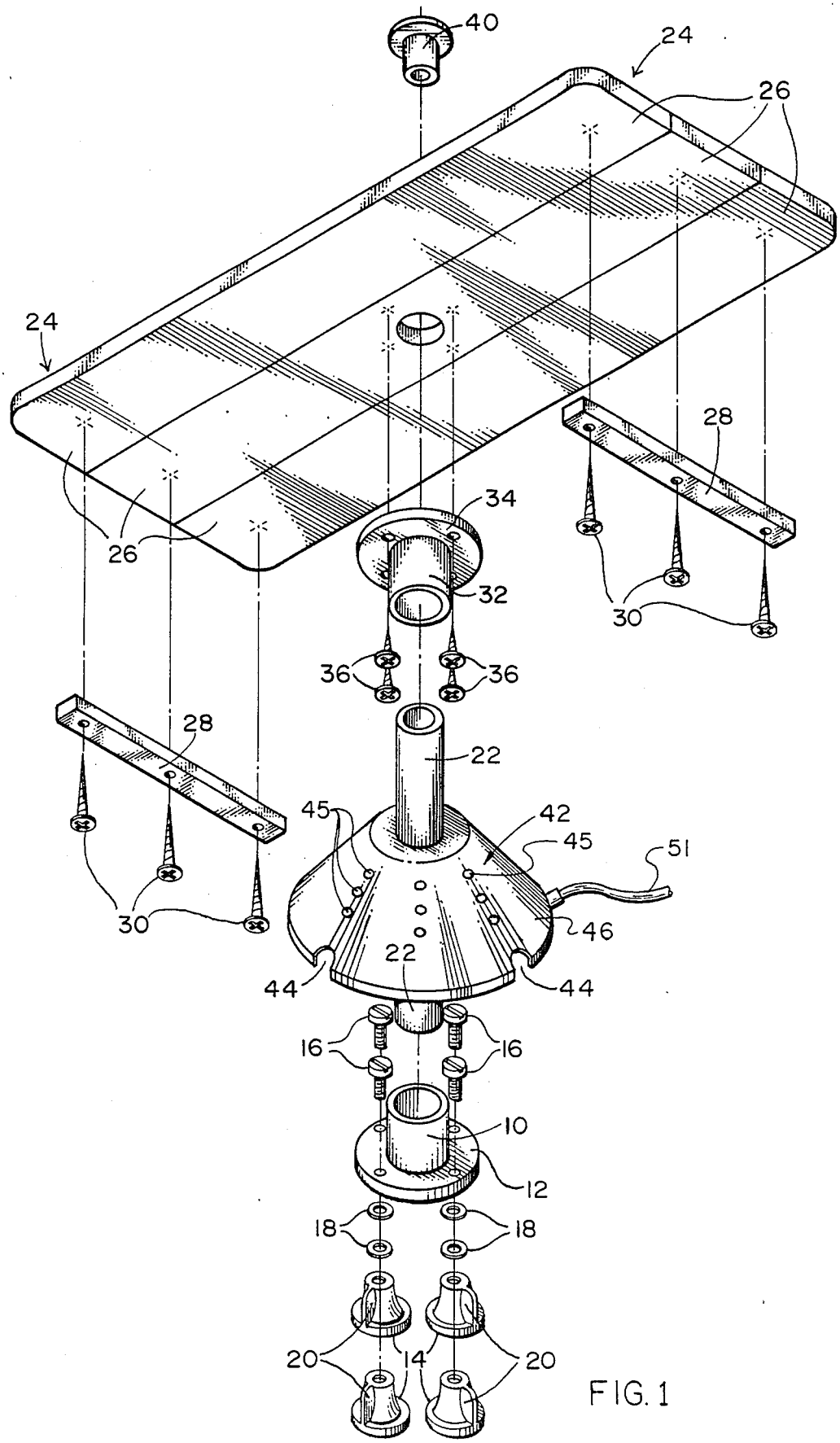
FIG. 1 is an exploded pictorial view of the novel table.

A novel pedestal table in accordance with the invention is shown in the drawings. The table is to be used in a hot tub, spa or whirlpool of the type having a smooth floor. The table is releasably secured to the smooth floor by suction cup means associated with the base member or pedestal of the table. The table can be quickly and easily installed in or removed from the hot tub, spa or whirlpool. The suction cup means for securing the pedestal to the floor area of the hot tub, spa or whirlpool do not deface, damage or mar the surface of the floor area and the pedestal can quickly and easily be removed entirely so as to leave the floor area in its original condition. Surprisingly, the suction cup means has been found to be very effective in securing the pedestal and table in a stable position, even against the turbulent action of the water and from being jarred by occupants of the hot tub, spa or whirlpool.

In a preferred embodiment of the pedestal table as illustrated in FIG. 1 of the drawings, the pedestal or base member of the table comprises a generally cylindrical collar 10 which has open first and second ends. The collar 10 can be made of any material which is resistant to the water environment in a hot tub, spa or whirlpool, such as stainless steel or other corrosion resistant metal, as well as polymeric materials. Preferably, the collar is made of a sturdy polymeric or plastic material such as nylon or ABS polymers.

A peripheral flange 12 extends from the collar 10 adjacent to the first end. Although not essential, it is preferable for the flange 12 to also cover or at least partially cover the open first end of the collar 10 for purposes as will be further described hereinafter. The flange 12 is preferably made of the same material as the collar 10. In the preferred embodiment the collar 10 and flange are molded as a unitary integral piece from a plastic material such as nylon or ABS polymer.

At least three, and in the preferred embodiment as illustrated, four elastomeric suction cups 14 are equally spaced about the peripheral flange 12 and extend downwardly from the side of the flange facing away from the cylindrical collar 10, such that the suction cups 14 can be engaged with and secured to the floor area of the hot tub, spa or whirlpool. The suction cups 14 are attached to the peripheral flange 12 by way of screws 16 which extend downwardly through corresponding holes in the flange 12. The upper ends of the suction cups 14 have nuts imbedded therein and are threaded securely to the screws 16. The suction cups preferably have a size such that they have a diameter of about three inches when pressed into contact with the floor area of the hot tub, spa or whirlpool.

The screws 16 and the imbedded nuts in the suction cups 14 are made of a corrosion resistant metal, preferably stainless steel. Stainless steel washers 18 can be positioned on the screws 16 between the flange 12 and the suction cups 14. The suction cups 14 advantageously have a small, integral tab 20 formed on the upper side surface thereof. The tab 20 on each suction cup 14 is adapted to be grasped between the thumb and forefinger and twisted in either direction to aid in releasing the suction cups 14 from the floor area when removal of the pedestal is desired. The suction cups 14 and the integral tabs 20 are molded from an elastomeric material.

An elongate, cylindrical column 22 having first and second ends is positioned such that the first end thereof is received coaxially within the second, upper, open end of the collar 10. The column 22 extends vertically upward from the collar 10, and a planar top member 24 is attached with appropriate attachment means to the second end of the column 22. It can now be seen why the flange 12 at least partially covers the bottom open end of the collar 10. The column 22 fits within the collar 10, and the portion of the flange 12 covering the bottom open end of the collar 10 becomes a bearing surface for the bottom end of the column 22. It is preferable to have the bottom end of column 22 bearing on the portion of the flange 12 rather than directly upon the floor area of the hot tub, spa or whirlpool so as to eliminate any chance of marring or otherwise damaging the surface of the floor area.

The column 22 can be made of any material which is corrosion resistant. Such materials include polymeric materials and metals such as stainless steel. In a preferred embodiment, the column 22 is made of ABS polymer. The column 22 can be of any desired length such that the top member 24 is supported above the surface of the water in the hot tub, spa or whirlpool. The exact length can be cut to fit the exact spa depth to position the attached table 24 at a desired level.

The table or top member 24 can be made of any appropriate, water resistant material such as redwood, teak, plastic, glass, etc. The top member 24 can further be of any shape and size which is desired and compatible with the hot tub, spa or whirlpool in which the table is to be used. As illustrated, it is advantageous to make the top member 24 of redwood or other water resistant wood. The wood material can be finished with appropriate finishes such as marine varnish to further protect the wood. In the illustrated embodiment, the top member 24 comprises three planks 26 of redwood which are fastened together by means of redwood struts 28 running perpendicular to the planks 26 and secured with corrosion resistant wood screws 30 to the planks 26.

The means for attaching the top member 24 to the column 22 advantageously comprises a cylindrical collar 32 and a flange 34 which are similar to the first collar 10 and first flange 12 of the base member or pedestal. The cylindrical collar 32 has two open ends, and the peripheral flange 34 extends from the upper, first end of the collar 32. The collar 10 and flange 34 can be made of the same materials used in making the first collar 10 and first flange 12 of the base member or pedestal. In a preferred embodiment, the collar 32 and flange 34 are molded as an integral unit from ABS polymer.

The flange 34 is attached to the underside surface of the planar top member 24 by appropriate attachment means such that the axis of the collar 32 is substantially perpendicular to the plane of the top member 24 and passed through the center of the top member 24. The attachment means are advantageously wood screws 36 which extend through appropriate holes in the flange 34 to engage the center plank 26 of the top member 24. The second end of the collar 32 is received in journal fashion on the second end of the column 22 so that the top member 24 is supported on the column 22 and is capable of rotation about the axis of the column 22.

In the preferred, illustrated embodiment of the table, the top member 24 has a center bore which is coaxial with the axis of the collar 32, and the column 22 has a hollow core. This allows a staff of a patio-type umbrella to be received through the bore in the table top member 24, and to extend through the collar 32 into the hollow column 22.

There must, of course, be a bearing surface for the top end of the column 22. In embodiments wherein no center hole is provided in the top member 24, the underside of the top member 24 may act as the bearing surface for the upper end of the column 22. Alternatively, the flange 34 could at least partially cover the top open end of the collar 32, with the portion of the flange 34 covering the open end of the collar 32 forming the bearing surface for the top end of the column 22. In the embodiment in which an opening is provided in the top member 24 for placement of a patio-type umbrella, there must be a continuous opening through the top member 24, and the collar 32 to accept the staff of the umbrella. In such embodiments, the flange 34 could be made to extend inwardly into the open end of the collar 32 by a limited distance equal to or somewhat less than the thickness of the cylindrical wall of the hollow column 22. The upper end of the column 22 would then abut on the small inward extension of the flange 34. Alternatively, the flange 34 need not cover any portion of the open end of the collar 32, but in such an embodiment, as illustrated in the drawing, a bushing 40 is placed in the central bore in the top member so as to be coaxial with the column 22. The bushing 40 can be glued in place or secured in place by other means. The lower end of the bushing 40 then provides the bearing surface for the upper end of the column 22.

In the preferred, illustrated embodiment, a conical cover 42 is provided for the cylindrical collar 10, flange 12 and suction cups 14 of the base member or pedestal. The cover 42 preferably has the shape of a truncated cone which encircles the column 22 and slides down over the collar 10, flange 12 and suction cups 14 to rest on the floor area of the hot tub, spa or whirlpool. The column 22 extends upwardly through the truncated top of the cover 42. Finger holes 44 can be spaced around the bottom edge of the cover 42 to allow the cover to be lifted upwardly when desired to expose the collar 10, flange 12 and suction cups 14 of the base member or pedestal. The cover is made of a corrosion resistant material including polymeric materials and corrosion resistant metals. This cover protects the suction cups from being inadvertently dislodged and also protects the feet of a user from being injured against the flange 12.

Figure 2:
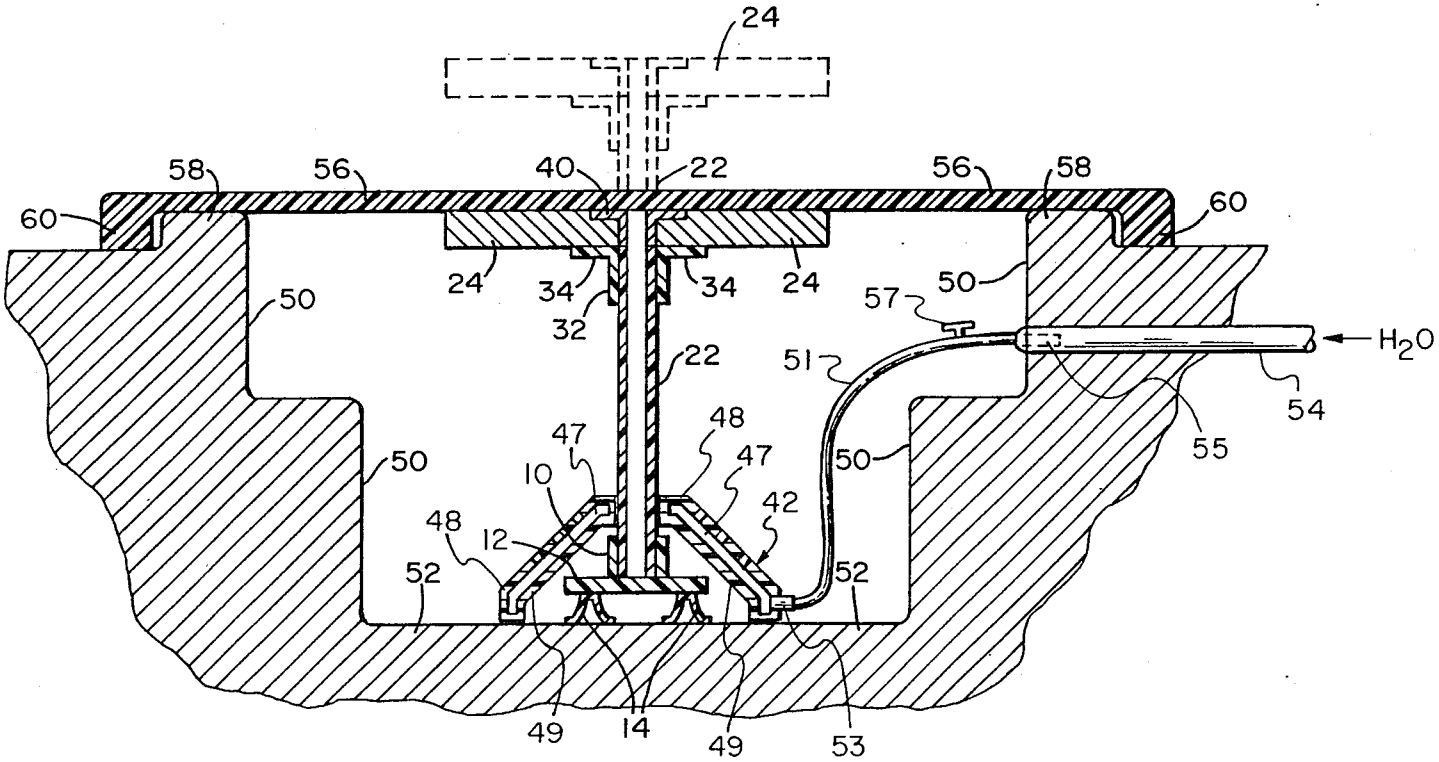
FIG. 2 is a cross section through a spa in which the pedestal table is situated, with the table being shown supporting the central area of a cover for the spa.

The cover 42 illustrated in FIGS. 1 and 2 also provides foot massage action at its outer surface. With this configuration, an occupant of the whirlpool may rest his feet on or over the cover and enjoy the relaxation of a foot massage. Such action is developed by pressurized water jets 45 that feed water under pressure through the cover and develop a turbulant, massaging action in the area immediately over the cover. The water jets are formed in a platform structure 46 which has its upper surface contoured to enhance contact with the sole of the foot. The water jets 45 having openings sufficiently narrow to maintain a pressure head of water within the jet.

FIG. 2 shows the platform in cross section, exposing a cavity 47 enclosed by an outer wall 48 and an inner wall 49. This cavity acts as a distributing compartment for the pressurized water carried by a conduit and received through inlet 53. The remaining end of the conduit is coupled to an existing water jet or outlet 54 of the whirlpool. The coupling may be a friction-seated insert plug 55 or any other coupling suitable to retain the conduit in connected condition at the outlet under the counterpressure of the pressurized water.

In this configuration, the platform 42 resembles an annularly shaped bladder in which the cavity 47 retains the water under pressure, allowing each of the openings 45 to operate as a jet. Water is ejected through the jet, forming a surface area of many small water jets which massage the sole of the foot. If increased water pressure within the bladder is desired, additional conduits may be coupled to feed the system. Most whirlpools have a strong enough head of pressure to provide an acceptable level of jet massage with a single conduit. A control valve 57 may be placed in line within the conduit to provide direct regulation of jet strength by controlling the rate of water flow to the bladder.

It will be apparent to those skilled in the art that numerous forms of water pressured massage systems may be adapted for use with the present invention. It is to be understood, therefore, that the subject embodiment is merely by way of example. Such devices could include rotating mechanical apparatus powered by the water, as well as direct application of water as described in the present embodiment.

The platform or bladder is inserted on the column through a central opening in the annulus. In this manner, the column provides support to the body of the platform. A snug fit of the platform around the column prevents it from rising up the column when not subject to the weight of an occupant's feet. Furthermore, the upward ejection of water assists in forcing the platform against the floor 52 of the whirlpool. In this manner, the use of water jets develops a synergistic effect of massaging the feet of occupants while at the same time urging the platform against the floor to protect from adverse contact with the rigid structure of the flange and cup assembly.

Another advantage of the pedestal table of the present invention is that it can be provided with two or more columns 22 having different lengths. As shown in FIG. 2, the table is situated in a spa or whirlpool comprising sidewalls 50 and a smooth floor area 52. The column 22 of the table is readily disengageable from both the collar 10 of the base member or pedestal and the collar 32 of the means for mounting the planar top member 24 to the column 22. Thus, by providing two or more columns 22 of different lengths, the elevation of the planar top member 24 can be changed by simply changing the column 22 to one of desired length.

As will be recognized, it may be desirable to change the elevation of the planar top member 24 in accordance with the activities occurring in the spa. For playing board games on the top member 24, it may be desirable to have the top member 24 positioned at a height different than when the top member 24 is being used to support refreshments such as food and drinks. Another distinct advantage of providing columns 22 of different lengths is that one column 22 can be provided for positioning the top surface of the planar top member 24 substantially in the plane of the top of the spa. Such an elevation is especially advantageous in that the top member 24 then is capable of serving as a center support for a cover over the spa.

For safety purposes as well as to conserve energy, covers are generally provided for spas, hot tubs and whirlpools. As shown in FIG. 2, the cover 56 comprises a planar member which spans the top of the spa. A raised lip or rim 58 is usually provided around the top edge of the spa, and the cover 56 generally rests upon this lip or rim 58. A downward lip 60 can be provided on the cover 56 to fit around the lip or rim 58 on the spa and, thus, retain the cover 56 in the desired position.

The covers 56 are generally made of a thin, rigid planar member such as plywood, wood decking, fiberglass, etc. The center of the cover is unsupported, and the cover 56 can deflect and break under the weight of a person who might traverse onto the cover 56 when the cover is placed in position over the spa. By placing the top surface of the planar top member 24 of the table of the present invention in the plane of the top of the spa, the top member 24 acts as a central support for the cover 56. When supported by the top member 24 of the table, the top cover 56 is fully capable of supporting the weight of one or more persons without deflecting and breaking or otherwise damaging the cover 56.

When used as a support for a top cover 56 on the spa, the top member 24 is confined in a small space relatively close to the water in the spa. It may be desirable to use a specially prepared top member 24 in such circumstances in place of the normal member 24. The specially prepared top member can be made of a strong, durable material which is corrosion resistant. Such materials include corrosion resistant metals and fiberglass reinforced plastics.

In FIG. 2, the longer column 22, shown in phantom, is used to support the normal top member 24 which is also shown in phantom. When the spa is to be covered, the longer column 22 is removed. The shorter column 22 is installed, and the top member 24 (either the normal table top member or a specially prepared top member) is placed on the shorter column 22 prior to covering the spa with the cover 56.

It is to be understood that the present disclosure, including the detailed description of the preferred embodiment, is made by way of example and that various other embodiments are possible without departing from the subject matter coming within the scope of the following claims, which subject matter is regarded as the invention.

We claim:

1. A foot massage device for use in a whirlpool system which has at least one outlet port for expelling a pressurized stream of water, said device comprising:

a submersible bladder having an outer wall and an inner cavity, said outer wall including a plurality of narrow openings communicating from the cavity through the outer wall to an upper surface, said openings being sufficiently narrow to maintain a pressure head of water flowing therethrough;

conduit for carrying water under pressure from the outlet port of the whirlpool system, one end of the conduit having means to couple the conduit to the outlet port; and coupling means attached between the bladder and a remaining end of the conduit to provide a pressurized water path from the outlet port to the openings of the bladder.

2. A foot massage device for use in a whirlpool system which has at least one outlet port for expelling a pressurized stream of water, said device comprising:

a submersible platform having an upper surface adapted for supporting contact of bare feet;

a plurality of water jets communicating from below the upper surface to open space immediately thereabove, said jets having openings sufficiently narrow to maintain a pressure head of water flowing therethrough;

conduit for carrying water under pressure from the outlet port of the whirlpool system, one end of the conduit having means to couple the conduit to the outlet port; and coupling means attached between the jets of the platform and a remaining end of the conduit to provide a pressurized water path for developing a fluid foot massage submersible within the whirlpool.

3. A foot massage device as defined in claim 2 wherein the platform is configured as an annular body adapted to fit around an upright support to thereby anchor the platform at one position near a floor portion of the whirlpool, said jets being dispersed around the annular body to provide a broad surface area of fluid massaging action.

4. A device as defined in claim 2, further comprising pedestal table in which the pedestal is to be releasably secured to the floor area of a smooth surfaced hot tub, spa or whirlpool, with the central support shaft of the table extending vertically through the water in the hot tub, spa or whirlpool to support a table top above the surface of the water, said pedestal table comprising a generally cylindrical collar having open first and second ends;

a peripheral flange extending from said collar adjacent to the first end of said collar;

at least three elastomeric suction cups attached to said peripheral flange such that the suction cups are equally spaced about the peripheral flange and extend from the side of the flange facing away from said cylindrical collar, wherein the suction cups can be engaged with the floor area of the hot tub, spa or whirlpool to releasably secure said collar to said floor area;

an elongate, cylindrical column having first and second ends, with the firt end being received in sliding, removable engagement within the second open end of said collar such that said column extends vertically upward from said collar;

a planar top member; and means for attaching the planar top member to said second end of said column;

said platform being configured for attachment to a base portion of the elongate column.

5. A table in accordance with claim 4, wherein four elastomeric suction cups are attached to the peripheral flange for engaging the floor area.

6. A table in accordance with claim 4, wherein the platform is configured as a cover for said cylindrical collar, said platform having the shape of a truncated cone in which the cone covers the peripheral flange, the suction cups and the cylindrical collar, with said column extending through the truncated top of said platform.

7. A table in accordance with claim 4, wherein said means for attaching the planar top member to said column comprises a second generally cylindrical collar having open first and second ends;

a second peripheral flange extending from said second collar adjacent to the first end of said second collar; and attachment means for attaching said second peripheral flange to the underside surface of the planar top member such that the axis of said second collar is substantially perpendicular to the plane of said top member and passes through the center of said top member, whereby said second end of said second collar is received in journal fashion on the second end of said column so that said top member is readily removable from and rotatable about said column.

8. A table in accordance with claim 7, wherein said column has a hollow core and a center bore is provided in said top member such that a staff of a patio-type umbrella can be received through said center bore and into the hollow core of said column.

9. A table in accordance with claim 8, wherein a bushing is situated in said center bore of said top member so as to be coaxial with said column.

10. A table in accordance with claim 7, wherein at least two columns are provided, with each column being a different length, whereby the height of the table can be adjusted by changing columns.

11. A hot tub, spa or whirlpool comprising:

a pressurized water outlet;

a smooth surfaced bottom;

upstanding sides extending from the bottom such that the bottom and sides form a container for containing a pool of water therein; and a pedestal table which is releasably secured to said smooth surfaced bottom, said pedestal table comprising a table top;

an elongate, column having first and second ends, with the first end including means for coupling to the table top;

a planar top member; and means for attaching the second end of said column to the bottom surface of the hot tub, spa or whirlpool;

a submersible platform attachable to the column and having an upper surface adapted for supporting contact of bare feet;

means coupled to the platform for generating a massaging action with respect to feet of an occupant which are positioned near the upper surface of the platform; submersible conduit for carrying pressurized water from the outlet of the whirlpool to the platform, said conduit including coupling means at one end to connect the conduit to the outlet; and coverting means operable to convert pressurized water flow into a source for generating the messaging action in the area above the platform surface.

12. A foot massage device for use in a whirlpool system comprising:

a submersible platform having an upper surface adapted for supporting contact of bare feet;

means coupled to the platform for generating a massaging action with respect to feet of an occupant which are positioned near the upper surface of the platform;

submersible conduit for carrying pressurized water from the outlet of the whirlpool to the platform, said conduit including coupling means at one end to connect the conduit to the outlet; and converting means operable to convert pressurized water flow into a source for generating the massaging action in the area above the platform surface.

* * * * *